US009309801B2

(12) United States Patent
Jayakar

(10) Patent No.: US 9,309,801 B2
(45) Date of Patent: Apr. 12, 2016

(54) SYSTEMS AND METHODS FOR A COOLING FLUID CIRCUIT

(75) Inventor: Vijayaselvan Jayakar, Bangalore (IN)

(73) Assignee: General Electric Company, Schenectady, NY (US)

( * ) Notice: Subject to any disclaimer, the term of this patent is extended or adjusted under 35 U.S.C. 154(b) by 728 days.

(21) Appl. No.: 13/548,163

(22) Filed: Jul. 12, 2012

(65) Prior Publication Data

US 2014/0014076 A1 Jan. 16, 2014

(51) Int. Cl.
*F02M 25/07* (2006.01)
*F01P 7/16* (2006.01)

(52) U.S. Cl.
CPC ..... *F01P 7/16* (2013.01); *F01P 2050/06* (2013.01); *F01P 2060/16* (2013.01); *F02M 25/0731* (2013.01)

(58) Field of Classification Search
CPC ..... F02M 25/07; F02M 25/0707; F02M 25/0704; F02M 25/0706; F02M 25/0726; F02M 25/0731; F01P 3/207; F01P 3/20; F01P 3/02; F01P 3/00; F01P 5/00; F01P 5/10; F01P 7/14; F01P 7/16
USPC ..... 123/568.12, 570, 563, 41.01–41.86; 701/108, 101, 104; 60/605.1, 605.2, 60/298; 165/41, 42
See application file for complete search history.

(56) References Cited

U.S. PATENT DOCUMENTS 5,004,042 A * 4/1991 McMorries et al. ..... 165/41
6,748,906 B1 * 6/2004 White et al. ..... 123/41.01
7,421,983 B1 * 9/2008 Taylor ..... 123/41.01
2001/0017127 A1 * 8/2001 Flynn et al. ..... 123/435
2006/0005791 A1 * 1/2006 Obidi ..... 123/41.29
2006/0065870 A1 * 3/2006 Mori et al. ..... 251/129.07
2006/0200297 A1 * 9/2006 Liu et al. ..... 701/104
2007/0056282 A1 * 3/2007 Iwaszkiewicz ..... 60/599
2007/0157893 A1 * 7/2007 Wei et al. ..... 123/41.08
2007/0227141 A1 10/2007 Ma et al.
2009/0318039 A1 12/2009 Hays

FOREIGN PATENT DOCUMENTS

DE 19629015 A1 1/1998
DE 20318321 U1 3/2004
DE 102006019282 A1 10/2007
EP 2039923 A1 3/2009
WO 2012125154 A1 9/2012
WO WO 2012125154 A1 * 9/2012

OTHER PUBLICATIONS

Search Report and Written Opinion from corresponding PCT Application No. PCT/US2013/047516 dated Oct. 1, 2013.

* cited by examiner

*Primary Examiner* — Stephen K Cronin
*Assistant Examiner* — Xiao Mo
(74) *Attorney, Agent, or Firm* — GE Global Patent Operation; John A. Kramer

(57) ABSTRACT

Various methods and systems are provided for cooling an engine system. In one example, a system includes an exhaust gas recirculation cooler and an engine. The system further includes a cooling fluid circuit in which the exhaust gas recirculation cooler and the engine are positionable in series with the exhaust gas recirculation cooler disposed upstream of the engine.

21 Claims, 3 Drawing Sheets

SYSTEMS AND METHODS FOR A COOLING FLUID CIRCUIT

FIELD

Embodiments of the subject matter disclosed herein relate to cooling circuits of engine systems.

BACKGROUND

Engines may utilize recirculation of exhaust gas from an engine exhaust system to an engine intake system, a process referred to as exhaust gas recirculation (EGR), to reduce regulated emissions. An EGR system may include an EGR cooler to cool the exhaust gas before it enters the intake system. In some examples, the EGR cooler and the engine may be coupled in parallel in a cooling fluid circuit. In such an example, however, an amount of cooling fluid may be increased and/or a flow rate of the cooling fluid may be doubled, for example, as similar flow rates of cooling fluid are sent through the engine and the EGR cooler. In other examples, the EGR cooler may be positioned downstream of the engine in the cooling circuit. As such, an engine operating temperature may be reduced due to cooler cooling fluid flowing through the engine, thereby reducing a thermal efficiency of the engine. Further, the cooling circuit may be pressurized in order to maintain the cooling fluid under its boiling point. In this case, degradation of a pressure cap may lead to engine or EGR cooler failure.

BRIEF DESCRIPTION

Thus, in one embodiment, an example system includes an exhaust gas recirculation cooler. The system further includes a cooling fluid circuit in which the exhaust gas recirculation cooler and an engine are positionable in series with the exhaust gas recirculation cooler disposed upstream of the engine.

In such an example, the cooling fluid flows through the EGR cooler before flowing through the engine. In this way, a temperature of the cooling fluid may be warmer when it enters the engine than if the EGR cooler is positioned downstream of the engine. As such, the engine temperature may be maintained at a higher temperature and thermal efficiency may be maintained. Further, because the cooling fluid flows through the EGR cooler and then the engine, a smaller amount of cooling fluid and/or a lower flow rate may be needed as compared to a system in which the EGR cooler and engine are coupled in parallel.

In some examples, the system may be positioned in a marine vessel. In such an example, ambient marine water in which the marine vessel is located may be used to provide cooling to the cooling fluid. As such, increased cooling of the cooling fluid may occur due to a relatively cold temperature of the marine water and a large supply of the marine water.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of methods and systems for cooling an engine system. In one exemplary embodiment, a system comprises an exhaust gas recirculation (EGR) cooler and an engine. The system further comprises a cooling fluid circuit in which the EGR cooler and the engine are positioned in series and the EGR is disposed upstream of the engine. In such an embodiment, the cooling fluid cools exhaust gas via the EGR cooler before cooling the engine. In this manner, a temperature of the engine may be maintained at a higher temperature, resulting in improved thermal efficiency. In some embodiments, the system may further include a pump disposed upstream of the EGR cooler in the cooling fluid circuit. In such a configuration, the pump supplies high pressure cooling fluid to the EGR cooler such that the cooling fluid is maintained below its boiling point. Thus, the need for a pressure cap may be reduced and degradation of components of the system due to degradation of the pressure cap may be reduced.

In one embodiment, the cooling fluid circuit may be part of an engine system positioned in a vehicle. In some embodiments, a marine vessel may be used to exemplify one of the types of vehicles having engine systems to which the cooling fluid circuit may provide cooling. Other types of vehicles may include locomotives, on-highway vehicles, and off-highway vehicles other than locomotives or other rail vehicles, such as mining equipment. Other embodiments of the invention may be used for engine systems that are coupled to stationary engines. The engine may be a diesel engine, or may combust another fuel or combination of fuels. Such alternative fuels may include gasoline, kerosene, biodiesel, natural gas, and ethanol. Suitable engines may use compression ignition and/or spark ignition.

Figure 1:
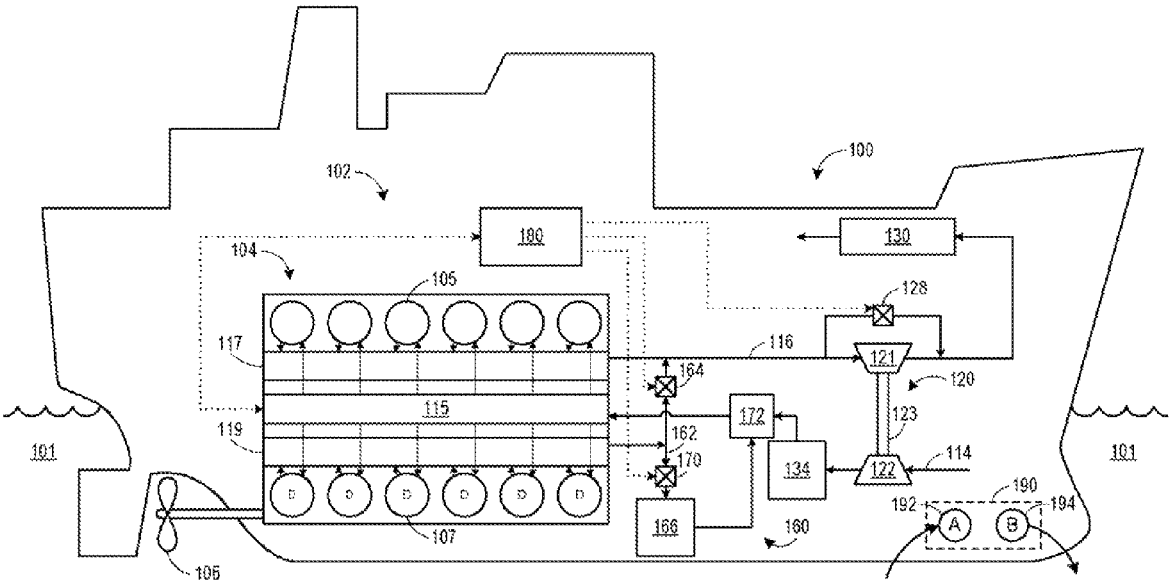
FIG. 1 shows a schematic diagram of an engine with an exhaust gas recirculation system in a marine vessel.

FIG. 1 shows a block diagram of an exemplary embodiment of a system, herein depicted as a marine vessel 100, such as a ship, configured to operate in a body of water 101. The marine vessel 100 includes an engine system 102, such as a propulsion system, with an engine 104. However, in other examples, engine 104 may be a stationary engine, such as in a power-plant application, or an engine in a rail vehicle propulsion system. In the exemplary embodiment of FIG. 1, a propeller 106 is mechanically coupled to the engine 104 such that it is turned by the engine 104. In other examples, the engine system 102 may include a generator that is driven by the engine, which in turn drives a motor that turns the propeller, for example.

The engine 104 receives intake air for combustion from an intake, such as an intake manifold 115. The intake may be any suitable conduit or conduits through which gases flow to enter the engine. For example, the intake may include the intake manifold 115, an intake passage 114, and the like. The intake passage 114 receives ambient air from an air filter (not shown) that filters air from outside of the vehicle in which the engine 104 is positioned. Exhaust gas resulting from combustion in the engine 104 is supplied to an exhaust, such as exhaust passage 116. The exhaust may be any suitable conduit through which gases flow from the engine. For example, the exhaust may include an exhaust manifold 117, the exhaust passage 116, and the like. Exhaust gas flows through the exhaust passage 116.

In the exemplary embodiment depicted in FIG. 1, the engine 104 is a V-12 engine having twelve cylinders. In other examples, the engine may be a V-6, V-8, V-10, V-16, I-4, I-6, I-8, opposed 4, or another engine type. As depicted, the engine 104 includes a subset of non-donor cylinders 105, which includes six cylinders that supply exhaust gas exclusively to a non-donor cylinder exhaust manifold 117, and a subset of donor cylinders 107, which includes six cylinders that supply exhaust gas exclusively to a donor cylinder exhaust manifold 119. In other embodiments, the engine may include at least one donor cylinder and at least one non-donor cylinder. For example, the engine may have four donor cylinders and eight non-donor cylinders, or three donor cylinders and nine non-donor cylinders. It should be understood, the engine may have any desired numbers of donor cylinders and non-donor cylinders, with the number of donor cylinders typically lower than the number of non-donor cylinders.

As depicted in FIG. 1, the non-donor cylinders 105 are coupled to the exhaust passage 116 to route exhaust gas from the engine to atmosphere (after it passes through an exhaust gas treatment system 130 and a turbocharger 120). The donor cylinders 107, which provide engine exhaust gas recirculation (EGR), are coupled exclusively to an EGR passage 162 of an EGR system 160 which routes exhaust gas from the donor cylinders 107 to the intake passage 114 of the engine 104, and not to atmosphere. By introducing cooled exhaust gas to the engine 104, the amount of available oxygen for combustion is decreased, thereby reducing combustion flame temperatures and reducing the formation of nitrogen oxides (e.g., $NO_x$).

In the exemplary embodiment shown in FIG. 1, when a second valve 170 is open, exhaust gas flowing from the donor cylinders 107 to the intake passage 114 passes through a heat exchanger such as an EGR cooler 166 to reduce a temperature of (e.g., cool) the exhaust gas before the exhaust gas returns to the intake passage. The EGR cooler 166 may be an air-to-liquid heat exchanger, for example. In such an example, one or more charge air coolers 134 disposed in the intake passage 114 (e.g., upstream of an EGR inlet where the recirculated exhaust gas enters) may be adjusted to further increase cooling of the charge air such that a mixture temperature of charge air and exhaust gas is maintained at a desired temperature. In other examples, the EGR system 160 may include an EGR cooler bypass.

Further, the EGR system 160 includes a first valve 164 disposed between the exhaust passage 116 and the EGR passage 162. The second valve 170 may be an on/off valve controlled by the controller 180 (for turning the flow of EGR on or off), or it may control a variable amount of EGR, for example. In some examples, the first valve 164 may be actuated such that an EGR amount is reduced (exhaust gas flows from the EGR passage 162 to the exhaust passage 116). In other examples, the first valve 164 may be actuated such that the EGR amount is increased (e.g., exhaust gas flows from the exhaust passage 116 to the EGR passage 162). In some embodiments, the EGR system 160 may include a plurality of EGR valves or other flow control elements to control the amount of EGR.

As shown in FIG. 1, the engine system 102 further includes an EGR mixer 172 which mixes the recirculated exhaust gas with charge air such that the exhaust gas may be evenly distributed within the charge air and exhaust gas mixture. In the exemplary embodiment depicted in FIG. 1, the EGR system 160 is a high-pressure EGR system which routes exhaust gas from a location upstream of a turbine of the turbocharger 120 in the exhaust passage 116 to a location downstream of a compressor of the turbocharger 120 in the intake passage 114. In other embodiments, the engine system 100 may additionally or alternatively include a low-pressure EGR system which routes exhaust gas from downstream of the turbocharger 120 in the exhaust passage 116 to a location upstream of the turbocharger 120 in the intake passage 114. It should be understood, the high-pressure EGR system provides relatively higher pressure exhaust gas to the intake passage 114 than the low-pressure EGR system, as the exhaust gas delivered to the intake manifold 114 in the high pressure EGR system has not passed through a turbine 121 of the turbocharger 120.

In the exemplary embodiment of FIG. 1, the turbocharger 120 is arranged between the intake passage 114 and the exhaust passage 116. The turbocharger 120 increases air charge of ambient air drawn into the intake passage 114 in order to provide greater charge density during combustion to increase power output and/or engine-operating efficiency. The turbocharger 120 includes a compressor 122 arranged along the intake passage 114. The compressor 122 is at least partially driven by the turbine 121 (e.g., through a shaft 123) that is arranged in the exhaust passage 116. While in this case a single turbocharger is shown, the system may include multiple turbine and/or compressor stages. In the example shown in FIG. 1, the turbocharger 120 is provided with a wastegate 128 which allows exhaust gas to bypass the turbocharger 120. The wastegate 128 may be opened, for example, to divert the exhaust gas flow away from the turbine 121. In this manner, the rotating speed of the compressor 122, and thus the boost provided by the turbocharger 120 to the engine 104, may be regulated during steady state conditions.

The engine system 100 further includes an exhaust treatment system 130 coupled in the exhaust passage in order to reduce regulated emissions. As depicted in FIG. 1, the exhaust gas treatment system 130 is disposed downstream of the turbine 121 of the turbocharger 120. In other embodiments, an exhaust gas treatment system may be additionally or alternatively disposed upstream of the turbocharger 120. The exhaust gas treatment system 130 may include one or more components. For example, the exhaust gas treatment system 130 may include one or more of a diesel particulate filter (DPF), a diesel oxidation catalyst (DOC), a selective catalytic reduction (SCR) catalyst, a three-way catalyst, a $NO_x$ trap, and/or various other emission control devices or combinations thereof.

The engine system 100 further includes the controller 180, which is provided and configured to control various components related to the engine system 100. In one example, the controller 180 includes a computer control system. The controller 180 further includes non-transitory, computer readable storage media (not shown) including code for enabling on-board monitoring and control of engine operation. The controller 180, while overseeing control and management of the engine system 102, may be configured to receive signals from a variety of engine sensors, as further elaborated herein, in order to determine operating parameters and operating conditions, and correspondingly adjust various engine actuators to control operation of the engine system 102. For example, the controller 180 may receive signals from various engine sensors including, but not limited to, engine speed, engine load, boost pressure, ambient pressure, exhaust temperature, exhaust pressure, etc. Correspondingly, the controller 180 may control the engine system 102 by sending commands to various components such as an alternator, cylinder valves, throttle, heat exchangers, wastegates or other valves or flow control elements, etc.

As another example, the controller 180 may receive signals from various temperature sensors and pressure sensors disposed in various locations throughout the engine system. In other examples, the first valve 164 and the second valve 170 may be adjusted to adjust an amount of exhaust gas flowing through the EGR cooler to control the manifold air temperature or to route a desired amount of exhaust to the intake manifold for EGR. As another example, the controller 180 may receive signals from temperature and/or pressure sensor indicating temperature and/or pressure of cooling fluid at various locations in a cooling fluid circuit, such as the cooling fluid circuit 216 described below with reference to FIG. 2. For example, the controller may control a cooling fluid flow through a thermostat based on an engine out cooling fluid temperature.

The marine vessel 100 further includes a bilge system 190, which, at least in part, removes water from a hull of the marine vessel 100. The bilge system 190 may include pumps, motors to run the pumps, and a control system. For example, the controller 180 may be in communication with the bilge system 190. As depicted in FIG. 1, the bilge system includes a first pump "A" 192 which draws ambient marine water from the body of water 101 onto the marine vessel. The ambient marine water may have a lower temperature than a temperature of air surrounding the marine vessel 100. Thus, the ambient marine water may provide increased cooling to a cooling fluid circuit, as will be described in greater detail below with reference to FIG. 2. The bilge system further includes a pump "B" 194 which pumps water from the marine vessel 100 into the body of water 101. The bilge system 190 may include a filtration system (not shown), for example, to remove contaminants from the water before it is pumped into the body of water 101.

Figure 2:
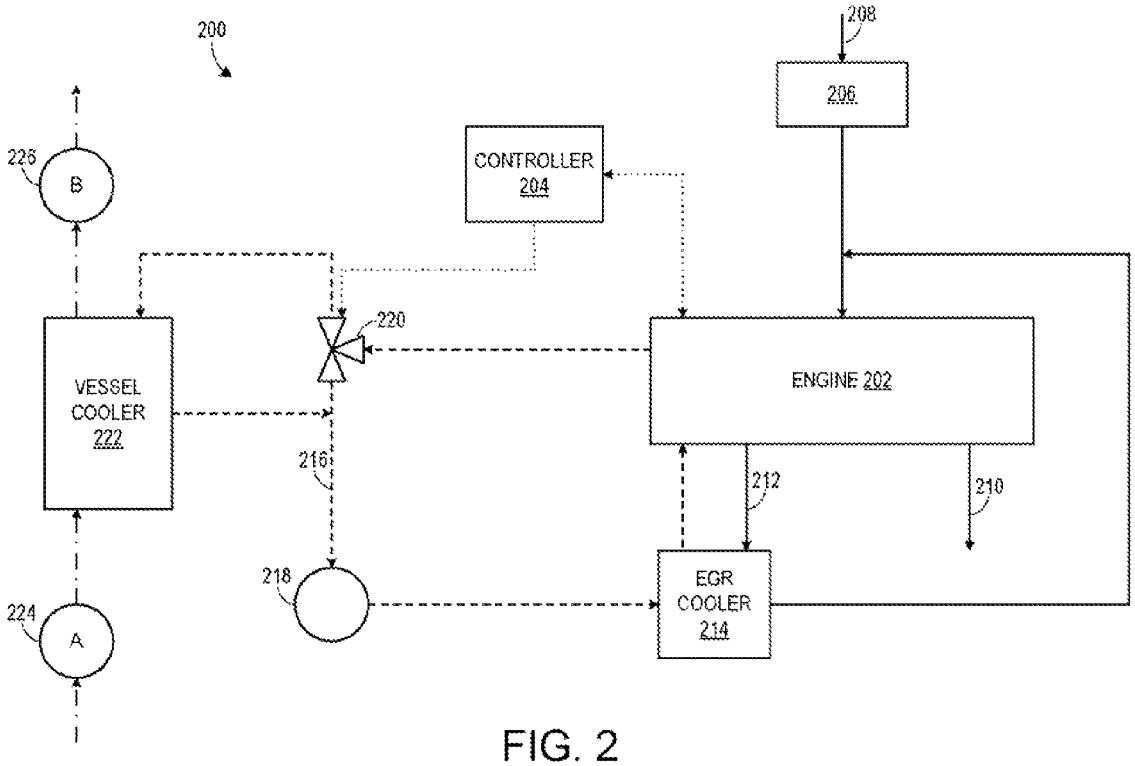
FIG. 2 shows a schematic diagram of a cooling fluid circuit which includes an engine and an exhaust gas recirculation cooler.

FIG. 2 shows a system 200 with an engine 202, such as the engine 104 described above with reference to FIG. 1. As depicted, air (indicated by a solid line in FIG. 2) flows through a charge air cooler 206, such as an intercooler before entering the engine 202 via an intake passage 208. As an example, the intake air may have a temperature of approximately 43° C. after passing through the charge air cooler 206. Some exhaust gas exhausted from the engine 202 is exhausted via an exhaust passage 210. For example, as described above, exhaust gas exhausted via the exhaust passage 210 may be from non-donor cylinders of the engine 202. Exhaust gas may be exhausted via the exhaust passage 212 for exhaust gas recirculation, for example. The exhaust gas exhausted via the exhaust passage 212 may be from donor cylinders of the engine 202, as described above. As an example, exhaust gas exhausted from the engine via either the donor cylinders or the non-donor cylinders may have a temperature of approximately 593° C.

The exhaust gas directed along the exhaust passage 212 flows through an EGR cooler 214 before it enters the intake passage 208 of the engine 202. The EGR cooler 214 may be a gas-to-liquid heat exchanger, for example, which cools the exhaust gas by transferring heat to a cooling fluid, such as a liquid cooling fluid. After passing through the EGR cooler, the temperature of the exhaust gas may be reduced to approximately 110° C., for example. Once the exhaust gas enters the intake passage 208 and mixes with the cooled intake air, the temperature of the charge air may be approximately 65° C. The temperature of the charge air may vary depending on the amount of EGR and the amount of cooling carried out by the charge air cooler 206 and the EGR cooler 214, for example.

As depicted in FIG. 2, the system 200 further includes a cooling fluid circuit 216. The cooling fluid circuit 216 directs cooling fluid (indicated by a dashed line in FIG. 2) through the EGR cooler 214 and the engine 202 to cool the EGR cooler 214 and the engine 202. The cooling fluid flowing through the cooling fluid circuit 216 may be engine oil or water, for example, or another suitable fluid. In the cooling fluid circuit 216 shown in the exemplary embodiment of FIG. 2, a pump 218 is disposed upstream of the EGR cooler 214. In such a configuration, the pump 218 may supply cooling fluid to the EGR cooler 214 at a desired pressure. As an example, the pressure of cooling fluid may be determined based on a boiling point of the cooling fluid and an increase in temperature of the cooling fluid that occurs due to heat exchange with exhaust gas in the EGR cooler 214 and heat exchange with the engine 202. In one example, a pressure of the cooling fluid exiting the pump 218 may be approximately 262,001 Pa (38 psi), have a flow rate of approximately 1703 liters per minute (450 gallons per minute), and have a temperature of approximately 68° C. By supplying the EGR cooler 214 with cooling fluid pressurized by the pump 218, boiling of the cooling fluid may be reduced. Further, as the cooling fluid is pressurized by the pump 218, the need for a pressure cap in the system is reduced and degradation of various components, such as the engine 202 and EGR cooler 214, due to degradation of the pressure cap may be reduced. In some embodiments, the pump 218 may be mechanically coupled to a crankshaft of the engine to rotate with the crankshaft, such that the pump 218 is driven by the crankshaft. In other embodiments, the pump 218 may be an electrically driven pump which is driven by an alternator of the engine system, for example.

In the exemplary embodiment shown in FIG. 2, the cooling fluid circuit cools the EGR cooler 214 of a high-pressure EGR system, such as the high-pressure EGR system 160 described above with reference to FIG. 1. In other embodiments, the cooling fluid circuit may additionally or alternatively provide cooling to an EGR cooler of a low-pressure EGR system.

As shown, cooling fluid flows from the pump 218 to the EGR cooler 214. Exhaust gas passing through the EGR cooler 214 transfers heat to the cooling fluid such that the exhaust gas is cooled before it enters the intake passage 208 of the engine 202. In the exemplary embodiment shown in FIG. 2, the EGR cooler 214 and the engine 202 are positioned in series. Thus, after cooling exhaust gas in the EGR cooler 214, the cooling fluid exits the EGR cooler 214 and enters the engine 202 where it cools the engine. Because the engine 202 is disposed downstream of the EGR cooler 214, the cooling fluid entering the engine 202 has a higher temperature than the cooling fluid entering the EGR cooler 214. As an example, the temperature of the cooling fluid exiting the EGR cooler 214 may have a temperature of approximately 84° C., which may vary depending on the cooling fluid temperature before it enters the EGR cooler 214, an amount of EGR passing through the EGR cooler 214, and the like. In this way, the engine may be maintained at a higher temperature, as the cooling fluid temperature is higher and less cooling occurs. As such, thermal efficiency of the engine may be increased.

The system 200 further includes a thermostat 220 positioned in the cooling fluid circuit downstream of the engine. The thermostat 220 may be adjusted to maintain an engine out temperature of the cooling fluid (e.g., the temperature of the cooling fluid as it exits the engine), for example. In some examples, the thermostat 220 may be an electronic thermostatic valve; while in other examples, the thermostat 220 may be a mechanical thermostatic valve. In some embodiments, a control system which includes a controller 204, such as the controller 180 described above with reference to FIG. 1, may control a position of the thermostat 220 based on the engine out cooling fluid temperature. As an example, the engine out cooling fluid temperature may be approximately 93° C. As one example, the thermostat may be adjusted such that no cooling fluid leaves the engine (e.g., the cooling fluid is stagnant in the engine), such as during engine warm-up, for example. As another example, the thermostat 220 may be adjusted to direct cooling fluid warmed by the engine 202 to the EGR cooler 214 without being cooled by a vessel cooler 222. In such an example, the warmed cooling fluid may mix with cooling fluid cooled by the vessel cooler 222 such that a temperature of the cooling fluid entering the EGR cooler 214 is relatively warmer. In this manner, thermal efficiency of the engine 202 may be maintained when there is a relatively small amount of exhaust gas recirculation, for example, and less heat transferred to the cooling fluid by the EGR cooler 214. As yet another example, the thermostat 220 may be adjusted such that substantially all of the cooling fluid exiting the engine 202 is directed to the vessel cooler 222. In this manner, the thermostat 222 is operable to maintain an engine out cooling out cooling fluid temperature.

The vessel cooler 222 may be a liquid-to-liquid heat exchanger, for example. As depicted in FIG. 2, cooling fluid from the engine 202 passes through the heat exchanger before it is directed to the pump 218. Cooling fluid passing through the vessel cooler 222 is cooled via heat transfer to ambient marine water (e.g., water from the body of water in which the marine vessel is positioned). For example, the vessel cooler may be fluidly coupled to a bilge system of the marine vessel, such as the bilge system 190 described above with reference to FIG. 1. In such a configuration, a pump A 224 may draw ambient marine water from external to the marine vessel (indicated by a dashed and dotted line in FIG. 2) and through the vessel cooler 222. Marine water warmed via heat exchange with the cooling fluid leaves the vessel cooler 222 and is exhausted out of the marine vessel via a pump B 226, for example. The ambient marine water may have a lower temperature than a temperature of air surrounding the marine vessel; as such, a greater heat exchange may occur between the cooling fluid and the marine water. Further, even greater cooling of the cooling fluid occurs, as the vessel cooler 222 is a liquid-to-liquid heat exchanger and a liquid-to-liquid heat exchanger provides a higher heat transfer rate than a liquid-to-air heat exchanger. Further still, because there is a large volume of the marine water and cooling of the marine water is not needed, it is possible to maintain a low temperature of the cooling fluid. In other embodiments, however, the vessel cooler may be a liquid-to-air heat exchanger, such as in a locomotive, off-highway vehicle, or stationary embodiment.

Thus, due to the relatively low temperature of the ambient marine water and the liquid-to-liquid heat transfer, the marine water may provide increased cooling of the cooling fluid as compared to air-based cooling systems. As such, a smaller EGR cooler may be used, thereby reducing a size and cost of the cooling system, for example. Further, because the EGR cooler 214 is positioned in series with the engine 202, an amount of cooling fluid flowing through the cooling fluid circuit may be reduced. For example, when the EGR cooler and engine are positioned in parallel, a greater amount of cooling fluid is needed to supply the EGR cooler and engine with similar flows of cooling fluid.

Figure 3:
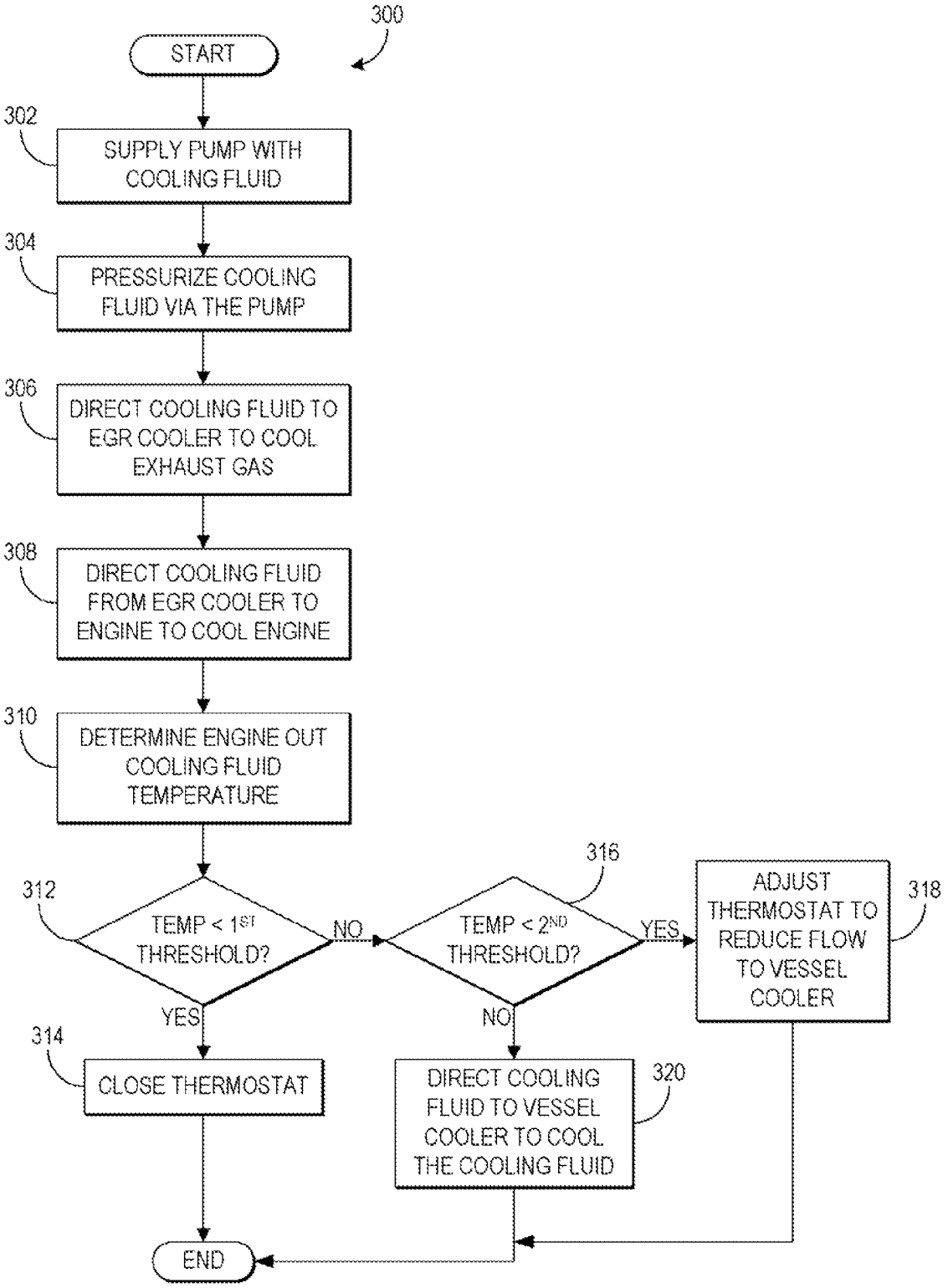
FIG. 3 shows a flow chart illustrating a method for a cooling fluid circuit.

An embodiment relates to a method (e.g., a method for a cooling fluid circuit). The method comprises pressurizing a cooling fluid with a pump, and directing the cooling fluid pressurized by the pump to an exhaust gas recirculation cooler, to cool recirculated exhaust gas from an engine. The method further comprises cooling the engine by directing cooling fluid exiting the exhaust gas recirculation cooler to the engine before returning it to the pump. An example of another embodiment of a method (for a cooling fluid circuit) is illustrated in the flow chart of, FIG. 3. Specifically, the method 300 directs cooling fluid through a cooling fluid circuit positioned in a marine vessel, such as the cooling fluid circuit 216 described above with reference to FIG. 2.

At step 302 of the method, a pump is supplied with cooling fluid. The cooling fluid may be cooled cooling fluid from a vessel cooler, for example. In some examples, the cooled cooling fluid from the vessel cooler may be mixed with cooling fluid exiting an engine such that a temperature of the cooling fluid is increased.

At step 304, the cooling fluid is pressurized via the pump. The output pressure of the pump may be based on a boiling point of the cooling fluid and an expected amount of heat transfer to the cooling fluid by an EGR cooler and/or the engine. For example, the cooling fluid may be pressurized so that the cooling fluid does not exceed its boiling point.

The pressurized cooling fluid is directed from the pump to the EGR cooler at step 306 to cool exhaust gas passing through the EGR cooler for exhaust gas recirculation. For example, heat is transferred from the exhaust gas to the cooling fluid such that the exhaust gas is cooled and the cooling fluid is warmed. At step 308, cooling fluid exiting the EGR cooler is directed to the engine, which is positioned in series with the EGR cooler, to cool the engine. For example, heat is transferred from various components of the engine to the cooling fluid such that a temperature of the cooling fluid increases and the engine is cooled.

At step 310, an engine out temperature of the cooling fluid is determined. As an example, the cooling fluid circuit may include a temperature sensor at an engine cooling fluid outlet. As another example, the temperature of the cooling fluid may be determined at a thermostat.

At step 312, it is determined if the engine out cooling fluid temperature is less than a first threshold temperature. If it is determined that the cooling fluid temperature is less than the first threshold temperature, the method continues to step 314 where the thermostat is closed such that the cooling fluid flow through the engine is reduced. On the other hand, if the engine out cooling fluid temperature is greater than the first threshold temperature, the method moves to step 316 where it is determined if the temperature is less than a second threshold temperature, where the second threshold temperature is greater than the first threshold temperature.

If it is determined that the engine out cooling fluid temperature is less than the second threshold temperature, the method proceeds to step 318 where the thermostat is adjusted such that at least a portion of the cooling fluid bypasses the vessel cooler. In this manner, a temperature of the engine may be maintained at a higher temperature to maintain engine efficiency, for example, even when an amount of EGR is reduced resulting in reduced heat transfer to the cooling fluid from exhaust gas in the EGR cooler. In contrast, if it is determined that the engine out cooling fluid temperature is greater than the second threshold temperature, the method moves to step 320 where all of the cooling fluid is directed to the vessel cooler.

Thus, by positioning the EGR cooler and the engine in series in a cooling fluid circuit, an amount of cooling fluid flowing through the cooling fluid circuit may be reduced, as the cooling fluid flows through the EGR cooler and then the engine. Because the cooling fluid is warmed by the EGR cooler before it enters the engine, less heat exchange may occur in the engine resulting in a higher engine operating temperature and greater thermal efficiency of the engine.

Further, because the cooling fluid is pressurized by the pump before it enters the EGR cooler, a possibility of boiling cooling fluid may be reduced.

Another embodiment relates to a system, e.g., a system for a marine vessel or other vehicle. The system comprises a reservoir for holding a cooling fluid, an exhaust gas recirculation cooler, an engine, and a cooling fluid circuit. (The reservoir may be a tank, but could also be a return line or other conduit, that is, the reservoir does not necessarily have to hold a large volume of cooling fluid. The reservoir is generally shown as pointed at by 216 in FIG. 2.) The cooling fluid circuit interconnects the reservoir, the exhaust gas recirculation cooler, and the engine. The cooling fluid circuit is configured to direct the cooling fluid in series from the reservoir, to the exhaust gas recirculation cooler, to the engine, and back to the reservoir. For example, in operation, the cooling fluid travels, in order from upstream to downstream: through a first conduit of the cooling fluid circuit from an outlet of the reservoir to an inlet of the exhaust gas recirculation cooler; through the exhaust gas recirculation cooler; through a second conduit of the cooling fluid circuit from an outlet of the exhaust gas recirculation cooler to an inlet of a cooling system (e.g., cooling jacket) of the engine; through the cooling system of the engine; and through a third conduit of the cooling fluid circuit from an outlet of the engine cooling system to an inlet of the reservoir. In another embodiment, the system further comprises a pump operably coupled with the reservoir and the cooling fluid circuit; the pump is configured to pressurize the cooling fluid that is directed through the cooling fluid circuit.

Another embodiment relates to a system, e.g., a system for a marine vessel or other vehicle. The system comprises a pump, an exhaust gas recirculation cooler, an engine, and a cooling fluid circuit. The cooling fluid circuit interconnects the pump, the exhaust gas recirculation cooler, and the engine. The cooling fluid circuit is configured to direct cooling fluid pressurized by the pump in series from the pump, to the exhaust gas recirculation cooler, to the engine, and back to the pump (or back to a return line or other reservoir to which the pump is operably coupled for receiving cooling fluid). For example, in operation, the cooling fluid pressurized by the pump travels, in order from upstream to downstream: through a first conduit of the cooling fluid circuit from an outlet of the pump to an inlet of the exhaust gas recirculation cooler; through the exhaust gas recirculation cooler; through a second conduit of the cooling fluid circuit from an outlet of the exhaust gas recirculation cooler to an inlet of a cooling system (e.g., cooling jacket) of the engine; through the cooling system of the engine; and through a third conduit of the cooling fluid circuit from an outlet of the engine cooling system to an inlet of the pump (or reservoir).

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

an exhaust gas recirculation cooler; and a cooling fluid circuit in which the exhaust gas recirculation cooler and an engine are positionable in series with the exhaust gas recirculation cooler disposed upstream of the engine, all cooling fluid to the engine entering the engine only from the exhaust gas recirculation cooler.

2. The system of claim 1, wherein the exhaust gas recirculation cooler is positioned in the circuit to receive cooling fluid entering at an inlet of the exhaust gas recirculation cooler upstream of the engine, and wherein the exhaust gas recirculation cooler is positioned upstream of the engine in the cooling fluid circuit.

3. The system of claim 2, further comprising a vessel cooler positioned in the cooling fluid circuit, the vessel cooler coupled to a bilge water system which pumps ambient marine water therethrough to cool cooling fluid in the cooling fluid circuit, where the vessel cooler is a liquid-to-liquid heat exchanger.

4. The system of claim 2, further comprising a pump positioned in the cooling fluid circuit and disposed upstream of the exhaust gas recirculation cooler, the pump operable to supply the exhaust gas recirculation cooler with pressurized cooling fluid, wherein the pump is mechanically coupled to a crankshaft of the engine to rotate with the crankshaft.

5. The system of claim 2, wherein the system is positioned in a marine vessel.

6. The system of claim 2, further comprising a high-pressure exhaust gas recirculation system coupled with the engine, wherein the exhaust gas recirculation cooler is coupled in the high-pressure exhaust gas recirculation system.

7. The system of claim 6, wherein the engine further comprises donor cylinders configured to supply the exhaust gas recirculation system with exhaust gas.

8. The system of claim 7, wherein the exhaust gas supplied to the exhaust gas recirculation system from the donor cylinders of the engine is controlled via a first valve and a second valve.

9. The system of claim 2, further comprising a thermostat positioned in the cooling fluid circuit and disposed downstream of the engine, the thermostat operable to maintain an engine out cooling fluid temperature.

10. The system of claim 2, wherein the exhaust gas recirculation cooler is positioned away from an intake manifold of the engine.

11. A method, comprising:

pressurizing a cooling fluid with a pump;

directing the cooling fluid pressurized by the pump to an exhaust gas recirculation cooler to cool recirculated exhaust gas from an engine, the cooling fluid entering the exhaust gas recirculation cooler upstream of the engine; and cooling the engine by directing cooling fluid exiting the exhaust gas recirculation cooler to the engine before returning it to the pump, all cooling fluid to the engine entering the engine only from the exhaust gas recirculation cooler.

12. The method of claim 11, further comprising cooling the cooling fluid by directing cooling fluid from the engine through a vessel cooler and then from the vessel cooler to the pump.

13. The method of claim 12, wherein the vessel cooler is positioned in a marine vessel, and further comprising drawing in marine water from external to the marine vessel, and exhausting the marine water out of the marine vessel after cooling the cooling fluid in the vessel cooler.

14. The method of claim 11, further comprising maintaining a temperature of cooling fluid exiting the engine via a thermostat.

15. The method of claim 11, further comprising supplying exhaust gas to the exhaust gas recirculation cooler from donor cylinders of the engine.

16. A system for a marine vessel, comprising:

an engine having one or more donor cylinders and one or more non-donor cylinders;

an exhaust gas recirculation system with an exhaust gas recirculation cooler disposed upstream of the engine in a cooling fluid circuit, the exhaust gas recirculation system supplied with exhaust gas from the one or more donor cylinders, the supply of exhaust gas controlled via a first valve and a second valve, all cooling fluid to the engine entering the engine only from the exhaust gas recirculation cooler;

a pump operable to provide high pressure cooling fluid to the exhaust gas recirculation cooler; and a vessel cooler disposed upstream of the pump in the cooling fluid circuit and operable to cool the cooling fluid via a bilge water system of the marine vessel.

17. The system of claim 16, wherein the bilge water system is operable to pump ambient marine water through the vessel cooler to cool the cooling fluid.

18. The system of claim 16, further comprising a turbocharger, and wherein an exhaust gas recirculation inlet of the exhaust gas recirculation system is positioned downstream of the turbocharger in an intake air passage of the engine.

19. The system of claim 16, wherein the vessel cooler is a liquid-to-liquid heat exchanger, and wherein the vessel cooler is configured to cool the cooling fluid via ambient marine water from external to the marine vessel.

20. A system, comprising:

a reservoir for holding cooling fluid;

an exhaust gas recirculation cooler;

an engine; and a cooling fluid circuit interconnecting the reservoir, the exhaust gas recirculation cooler, and the engine, wherein the cooling fluid circuit is configured to direct cooling fluid in series from the reservoir, only to the exhaust gas recirculation cooler, only to the engine, and only back to the reservoir, the engine supplied with cooling fluid only from the cooling fluid circuit.

21. The system of claim 20, further comprising a pump operably coupled with the reservoir and the cooling fluid circuit, wherein the pump is configured to pressurize the cooling fluid that is directed through the cooling fluid circuit.

* * * * *